US008961107B2

(12) United States Patent
Su et al.

(10) Patent No.: US 8,961,107 B2
(45) Date of Patent: Feb. 24, 2015

(54) HEAT-DISSIPATION FAN

(75) Inventors: Yen-Min Su, Pingtung County (TW); Kao-Chuan Huang, Pingtung County (TW); Chi-Ping Lai, Pingtung County (TW); Jiun-Shian Guo, Pingtung County (TW)

(73) Assignee: ADDA Corp., Pingtung, Pingtung County (TW)

( * ) Notice: Subject to any disclaimer, the term of this patent is extended or adjusted under 35 U.S.C. 154(b) by 386 days.

(21) Appl. No.: 13/473,770

(22) Filed: May 17, 2012

(65) Prior Publication Data

US 2013/0309077 A1 Nov. 21, 2013

(51) Int. Cl.
*F04D 17/16* (2006.01)
*F04D 29/30* (2006.01)

(52) U.S. Cl.
USPC ..... 415/102; 415/206; 416/175; 416/203; 416/179; 416/181; 416/183; 416/185; 416/196 A; 416/223 B

(58) Field of Classification Search
CPC ..... F04D 17/16; F04D 29/281; F04D 29/282; F04D 29/30; F04D 29/663; F04D 29/666; F04D 29/668
USPC ..... 415/101, 102, 204, 206; 416/175, 203, 416/179, 183, 185, 186 R, 181, 196 R, 416/196 A, 223 B
See application file for complete search history.

(56) References Cited

U.S. PATENT DOCUMENTS

| | | | | |
|---|---|---|---|---|
| D587,363 | S * | 2/2009 | Rheault | D23/413 |
| 2008/0130226 | A1* | 6/2008 | Yamashita et al. | 415/203 |
| 2009/0053052 | A1* | 2/2009 | Hwang et al. | 416/179 |
| 2011/0058938 | A1* | 3/2011 | Chen | 415/206 |
| 2011/0064570 | A1* | 3/2011 | O'Connor et al. | 415/203 |

FOREIGN PATENT DOCUMENTS

| | | |
|---|---|---|
| JP | 2008-185000 A | 8/2008 |
| TW | M394689 | 12/2010 |

OTHER PUBLICATIONS

Taiwanese Office Action mailed Oct. 22, 2014 for Taiwanese Patent Application No. 101113872, 10 pages.

* cited by examiner

*Primary Examiner* — Christopher Verdier
(74) *Attorney, Agent, or Firm* — Jackson IPG PLLC

(57) ABSTRACT

A heat-dissipation fan including a base and an impeller disposed at the base, wherein the impeller includes a plurality of first blades, a plurality of second blades and a plurality of connection ribs. Each of the first blades and each of the second blades are arranged alternately. Each of the connection ribs comprises a first edge, a second edge and a third edge. The first edge is connected with the first blade, the second edge is connected with the second blade, the third edge is connected with the first edge and the second edge, and the third edge and the second blade are spaced apart to form a first vent. The first edge comprises a first length, the second edge comprises a second length, and the first length is larger than the second length.

14 Claims, 12 Drawing Sheets

HEAT-DISSIPATION FAN

FIELD OF THE INVENTION

The present invention is generally related to a heat-dissipation fan, which particularly relates to the heat-dissipation fan for increasing air volume of heat dissipation.

BACKGROUND OF THE INVENTION

With reference to FIG. 12, a conventional heat-dissipation fan 200 comprises a base 210, an impeller 220 disposed at the base 210 and a lid 230, wherein the impeller 220 is covered with the lid 230. The impeller 220 comprises a hub 221 and a plurality of blades 222. When the impeller 220 is actuated to start rotation, the air is beaten by the rotating blades 222 to discharge laterally for achieving heat dissipation. However, an appropriate design of flow guidance is absent for the impeller 220. An air disturbance between the rotating blades 222 is occurred when the air is exhausted into the blades 222, which lowers air volume of heat dissipation and brings annoying noises.

SUMMARY

The primary object of the present invention is to provide a heat-dissipation fan comprising a base and an impeller disposed at the base. The impeller includes a hub, a plurality of first blades disposed around the hub, a plurality of second blades disposed around the hub and a plurality of connection ribs. Each of the first blades and each of the second blades are arranged alternately. Each of the first connection ribs comprises a first edge, a second edge and a third edge, wherein the first edge is connected with the first blade, the second edge is connected with the second blade, and the third edge is connected with the first edge and the second edge. The third edge and the second blade are spaced apart to form a first vent. The first edge comprises a first length, the second edge comprises a second length, and the first length is larger than the second length.

When the impeller of the heat-dissipation fan starts rotation, the air penetrated between the first blade and the second blade can be divided into two parts via the connection rib. The two parts of the air flow along a top surface and a bottom surface of the connection rib, and the divided air is beaten by the first blade so as to discharge laterally, which may prevent an air disturbance between the first blade and the second blade from happening to increase lateral air volume of heat dissipation. Besides, annoying noises caused from air disturbance can be avoidable.

DETAILED DESCRIPTION OF THE INVENTION

Figure 1:
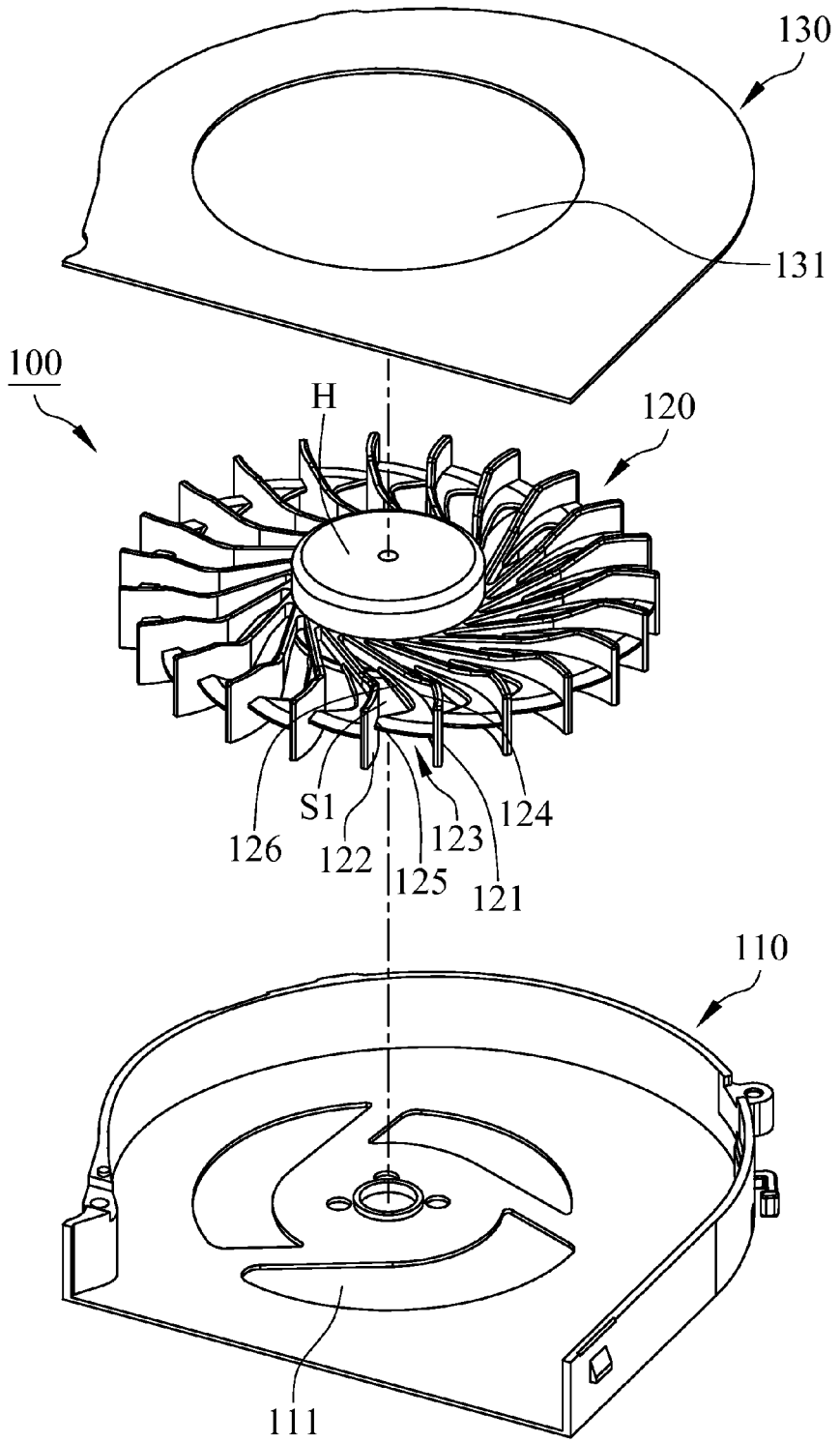
FIG. 1 is a perspective exploded view illustrating a heat-dissipation fan in accordance with a first embodiment of the present invention.
Figure 2:
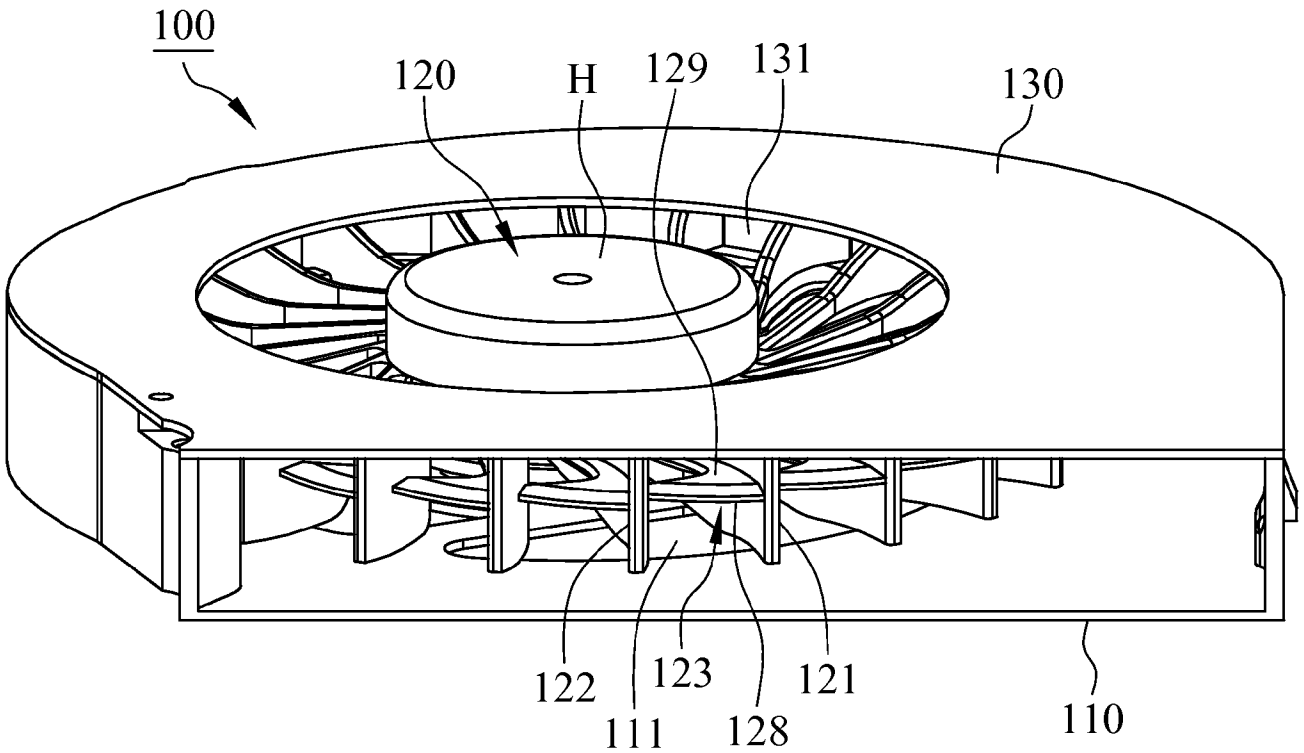
FIG. 2 is a perspective assembly view illustrating a heat-dissipation fan in accordance with a first embodiment of the present invention.
Figure 3:
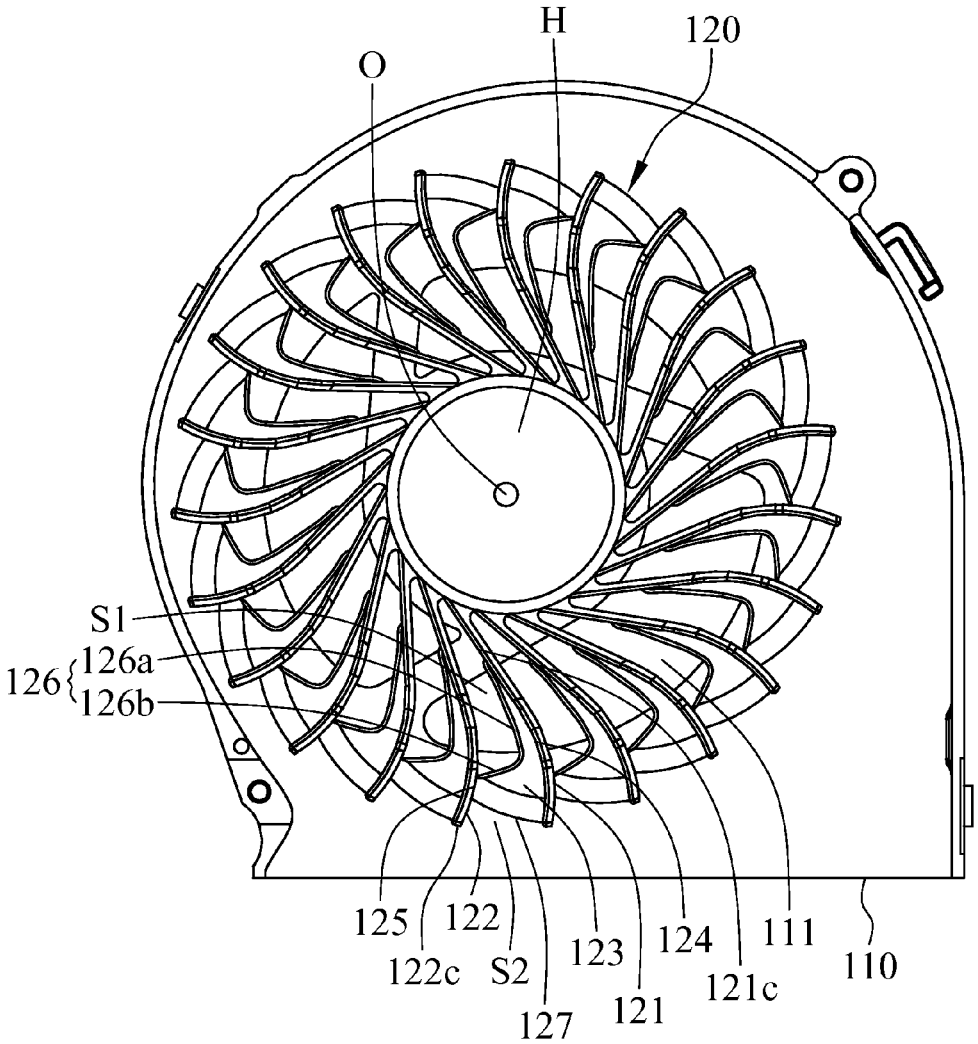
FIG. 3 is a top view illustrating a heat-dissipation fan in accordance with a first embodiment of the present invention.
Figure 5:
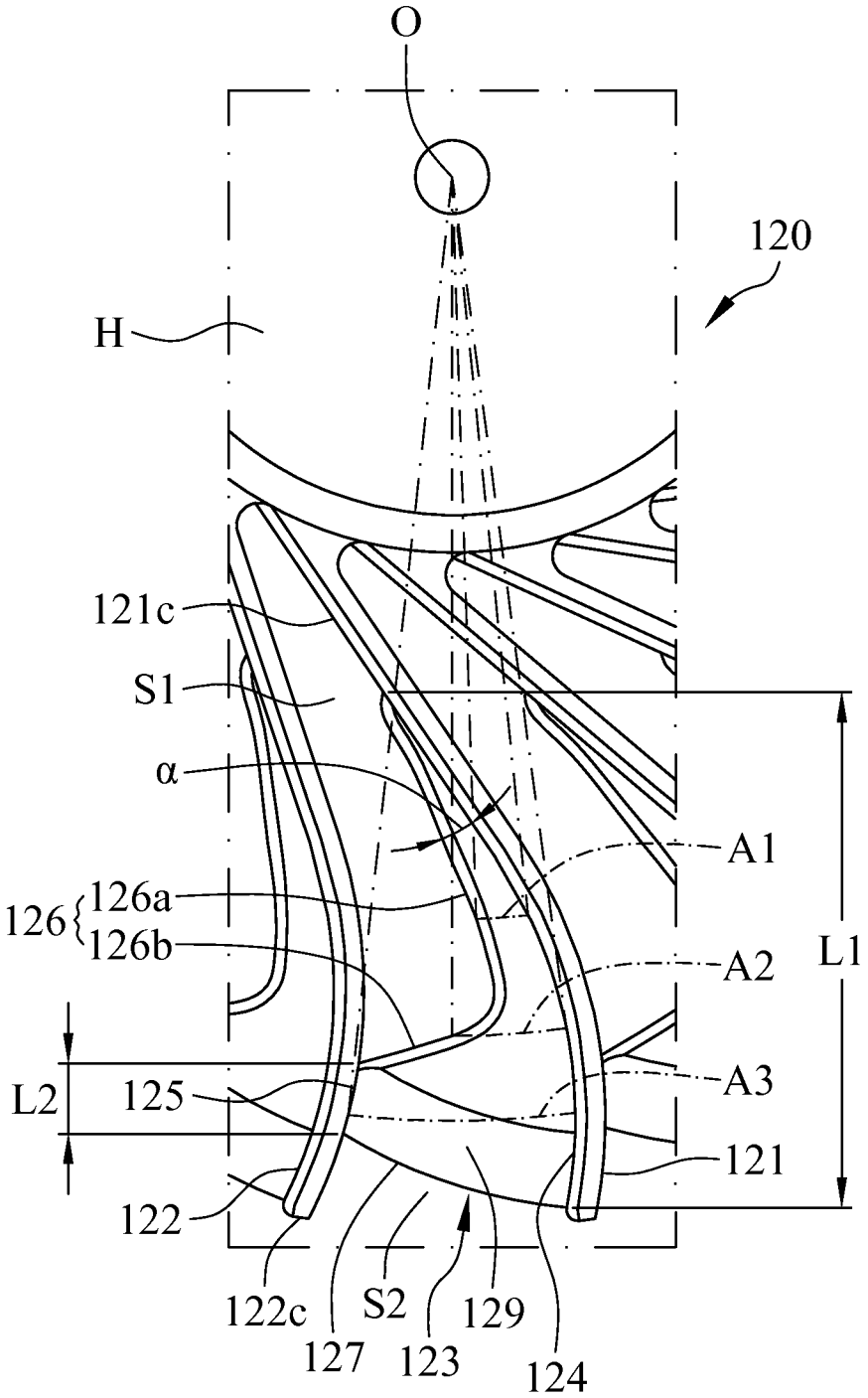
FIG. 5 is a partial enlargement diagram of FIG. 4.

With reference to FIGS. 1, 2 and 3, a heat-dissipation fan 100 in accordance with a first preferred embodiment of the present invention includes a base 110, an impeller 120 disposed at the base 110 and a lid 130 coupled to the base 110, wherein the impeller 120 is covered with the lid 130. The base 110 comprises at least one bottom opening 111, the lid 130 comprises a top opening 131, and the impeller 120 includes a hub H, a plurality of first blades 121 disposed around the hub H, a plurality of second blades 122 disposed around the hub H and a plurality of connection ribs 123. Each of the first blades 121 and each of the second blades 122 are arranged alternately from each other. Each of the connection ribs 123 comprises a first edge 124, a second edge 125, a third edge 126, a bottom surface 128 and a top surface 129, wherein the first edge 124 is connected with the first blade 121, the second edge 125 is connected with the second blade 122, the third edge 126 is connected with the first edge 124 and the second edge 125. The third edge 126, the first blade 121 and the second blade 122 are spaced apart to form a first vent S1 corresponded to the bottom opening 111 and the top opening 131. With reference to FIG. 5, the first edge 124 comprises a first length L1, the second edge 125 comprises a second length L2, and the first length L1 is larger than the second length L2. The third edge 126 includes a first side edge 126*a* and a second side edge 126*b*, in this embodiment, the first side edge 126*a* is more adjacent to the hub H than the second side edge 126*b*, and the third edge 126 can be an arcuate shaped edge.

Figure 4:
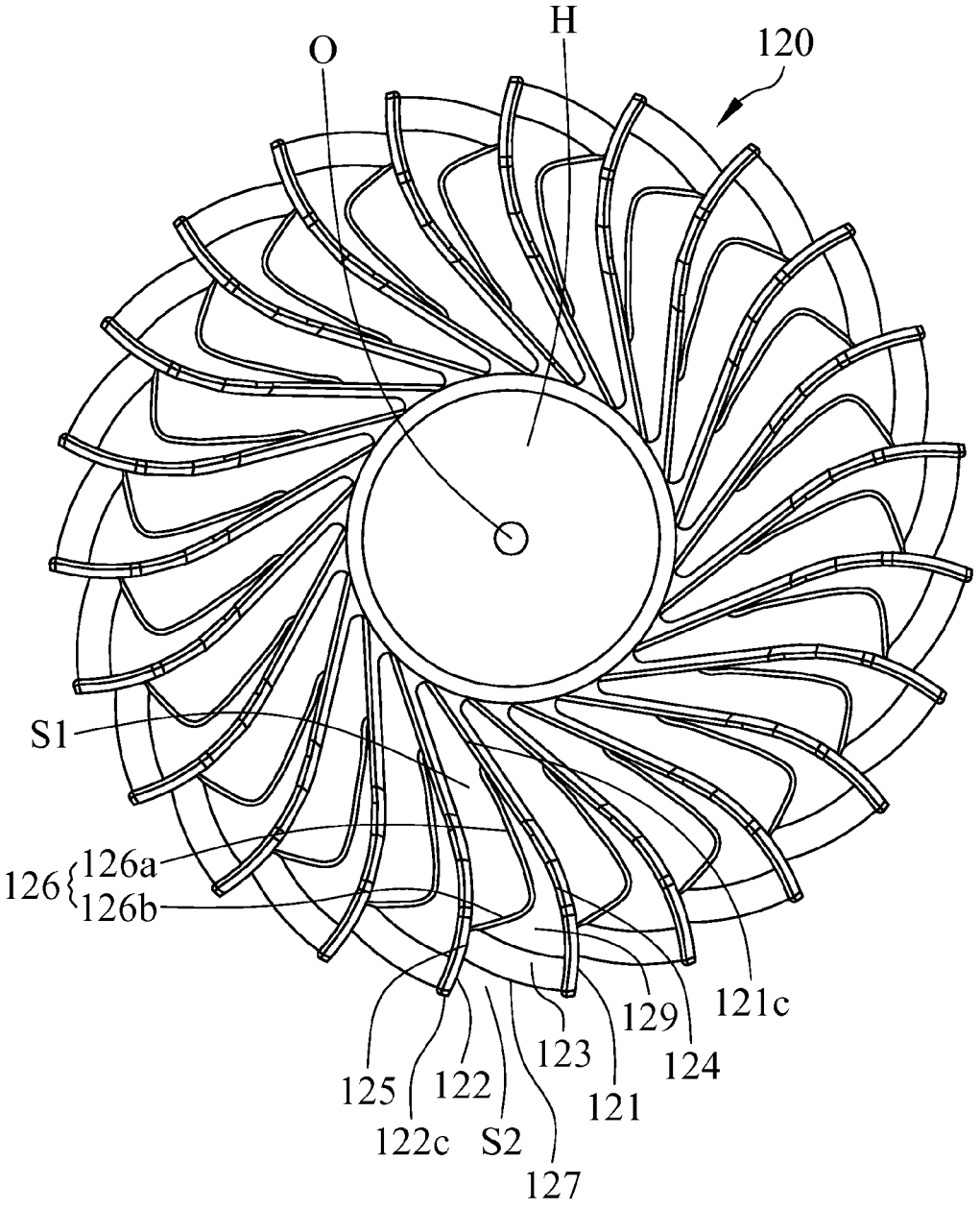
FIG. 4 is a top view illustrating an impeller of a heat-dissipation fan in accordance with a first embodiment of the present invention.

Referring to FIGS. 4 and 5, in this embodiment, the impeller 120 comprises a rotation center O, wherein the rotation center O is utilized as a base point so that a first arc length A1 can be defined between the first side edge 126*a* and the first edge 124, a second arc length A2 can be defined between the second side edge 126*b* and the first edge 124, and a third arc length A3 can be defined between the second edge 125 and the first edge 124. The third arc length A3 is larger than the second arc length A2, and the second arc length A2 is larger than the first arc length A1. In this embodiment, the connection rib 123 is formed in a divergent shape from the hub H to a fourth edge 127 of the connection rib 123, and each of the connection ribs 123 can be roughly sickle shaped. When the impeller 120 of the heat-dissipation fan 100 starts rotation, the air penetrated between the first blade 121 and the second blade 122 can be divided into two parts via the connection rib 123. The two parts of the air flow along the top surface 129 and the bottom surface 128 of the connection rib 123, and the divided air is then beaten by the first blade 121 so as to discharge laterally, which may prevent an air disturbance between the first blade 121 and the second blade 122 from happening to increase lateral air volume of heat dissipation. Besides, owning to the reason that the air disturbance is absent between the first blade 121 and the second blade 122, annoying noises caused from air disturbance can be avoidable.

With reference to FIGS. 4 and 5, in this embodiment, each of the first blades 121 comprises a surface 121*c*, each of the second blades 122 comprises a lateral 122*c*, and the fourth edge 127 is connected with the first edge 124 and the second edge 125. The fourth edge 127 is farther from the hub H than the third edge 126, and the third edge 126 is not parallel to the fourth edge 127. The fourth edge 127 and the lateral 122*c* of the second blades 122 are spaced apart to form a second vent S2, wherein airflow flows into the second vent S2 to increase the overall air volume within the heat-dissipation fan 100. Besides, an inclined angle α between the first side edge 126*a* of the third edge 126 and the surface 121*c* of the first blade 121 ranges from 15 to 30 degrees. Preferably, the inclined angle α is 15 degrees, the optimized design of the inclined angle α enables the impeller 120 of the heat-dissipation fan 100 to raise the lateral air volume of heat dissipation.

Figure 6:
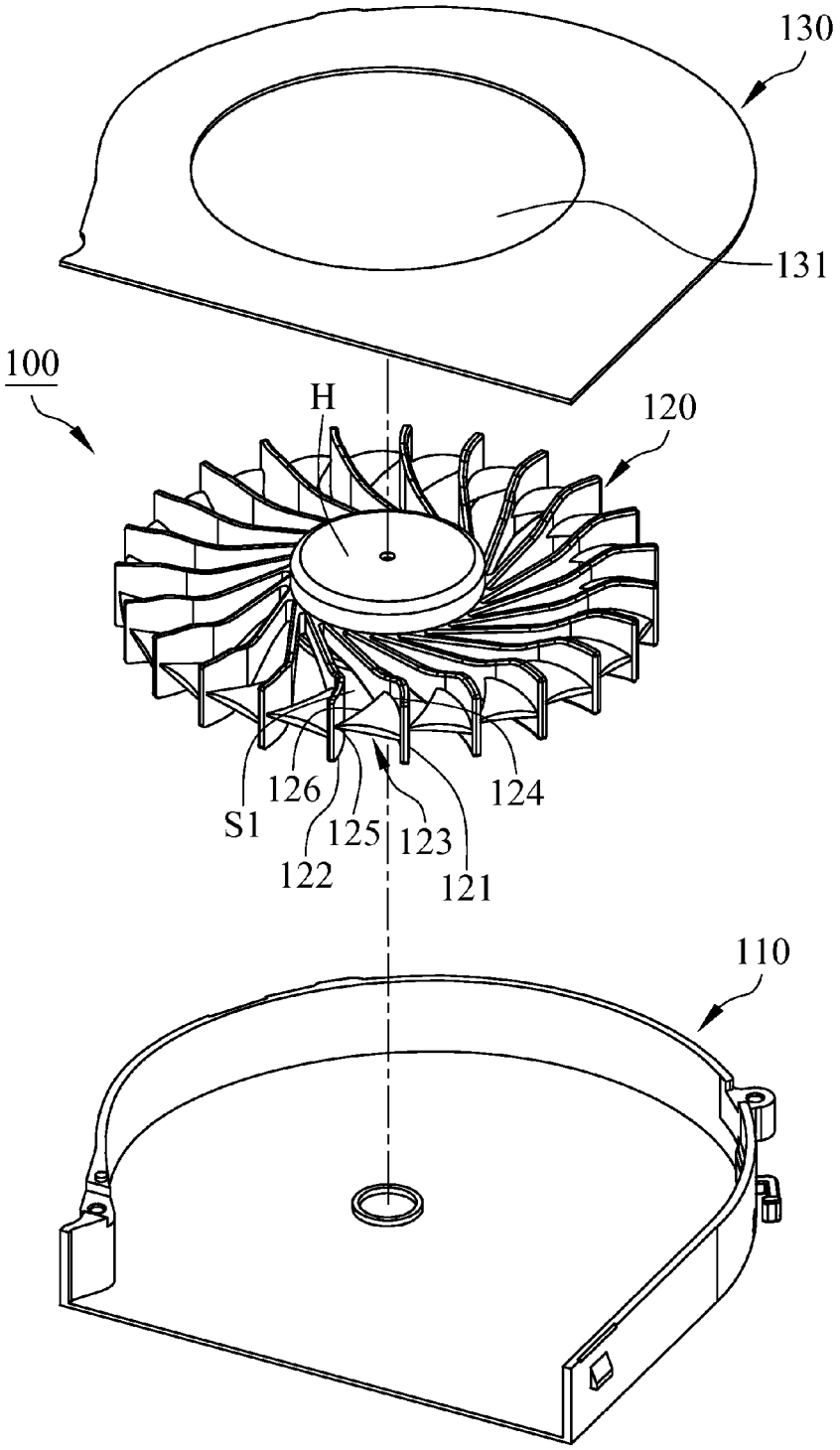
FIG. 6 is a perspective exploded view illustrating a heat-dissipation fan in accordance with a second embodiment of the present invention.
Figure 7:
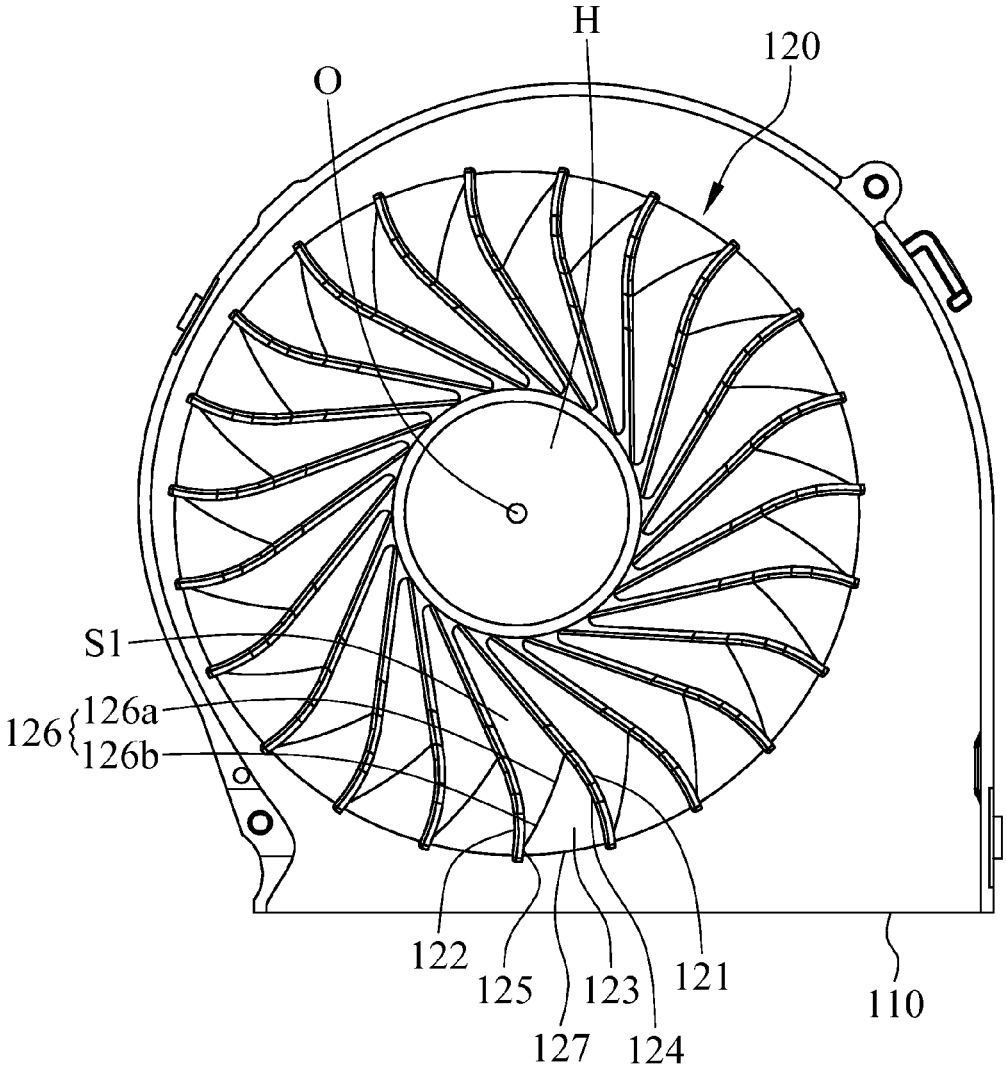
FIG. 7 is a top view illustrating a heat-dissipation fan in accordance with a second embodiment of the present invention.
Figure 8:
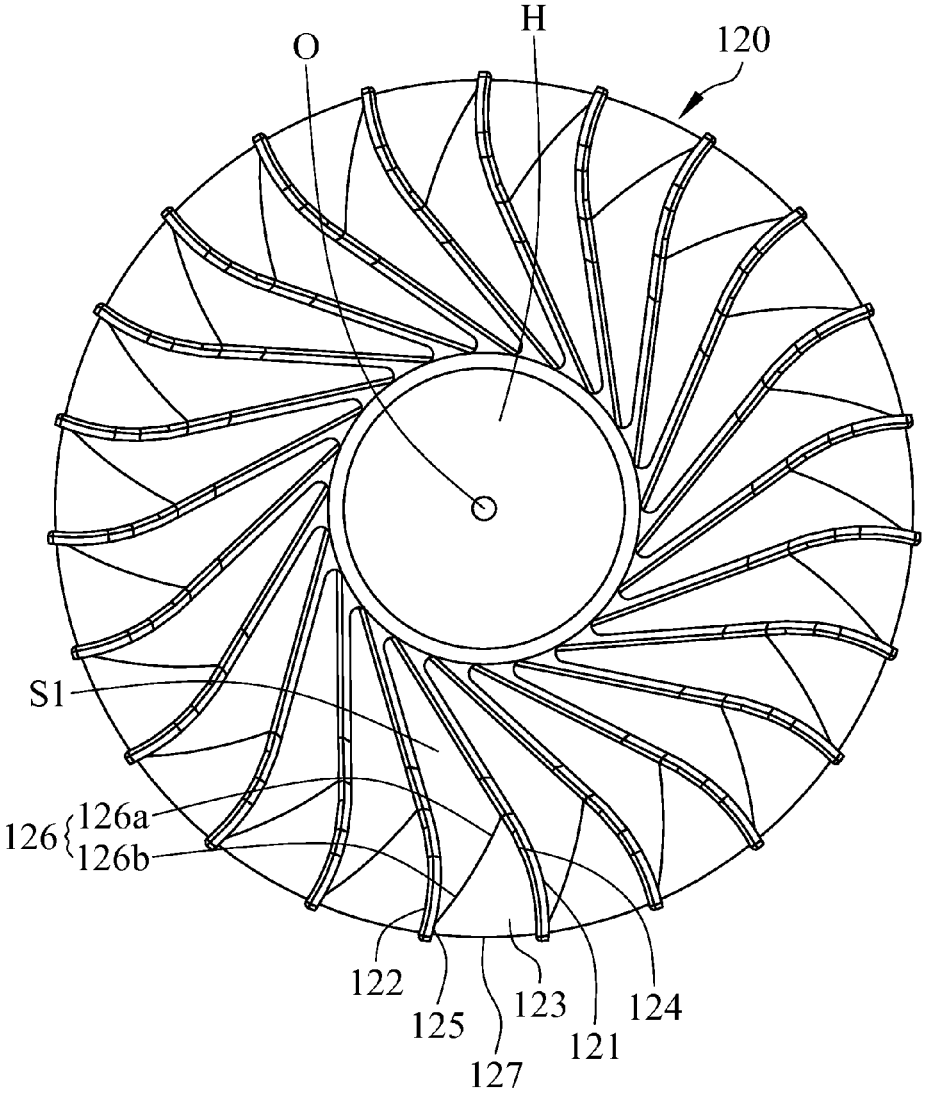
FIG. 8 is a top view illustrating an impeller of a heat-dissipation fan in accordance with a second embodiment of the present invention.
Figure 9:
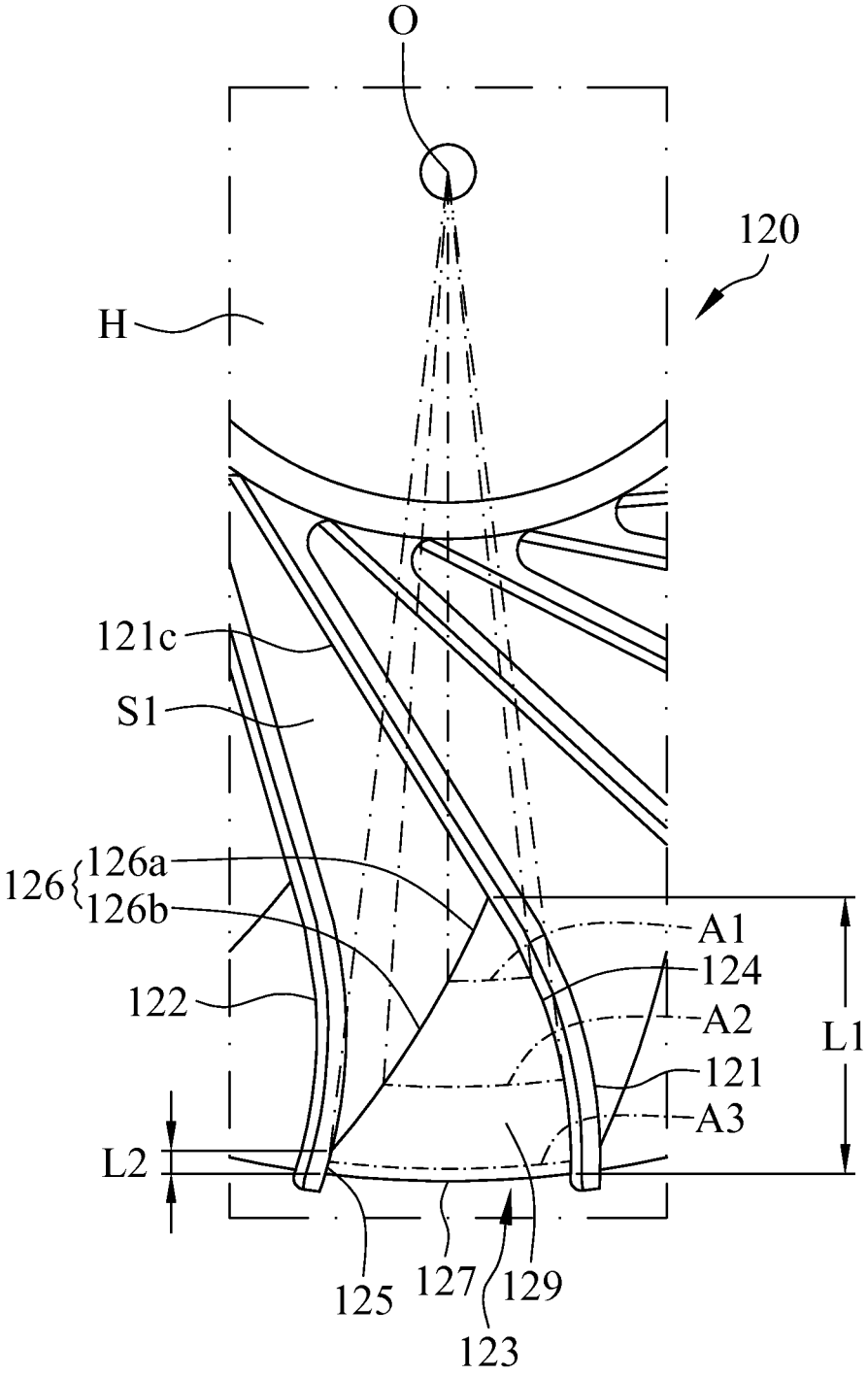
FIG. 9 is a partial enlargement diagram of FIG. 8.
Figure 10:
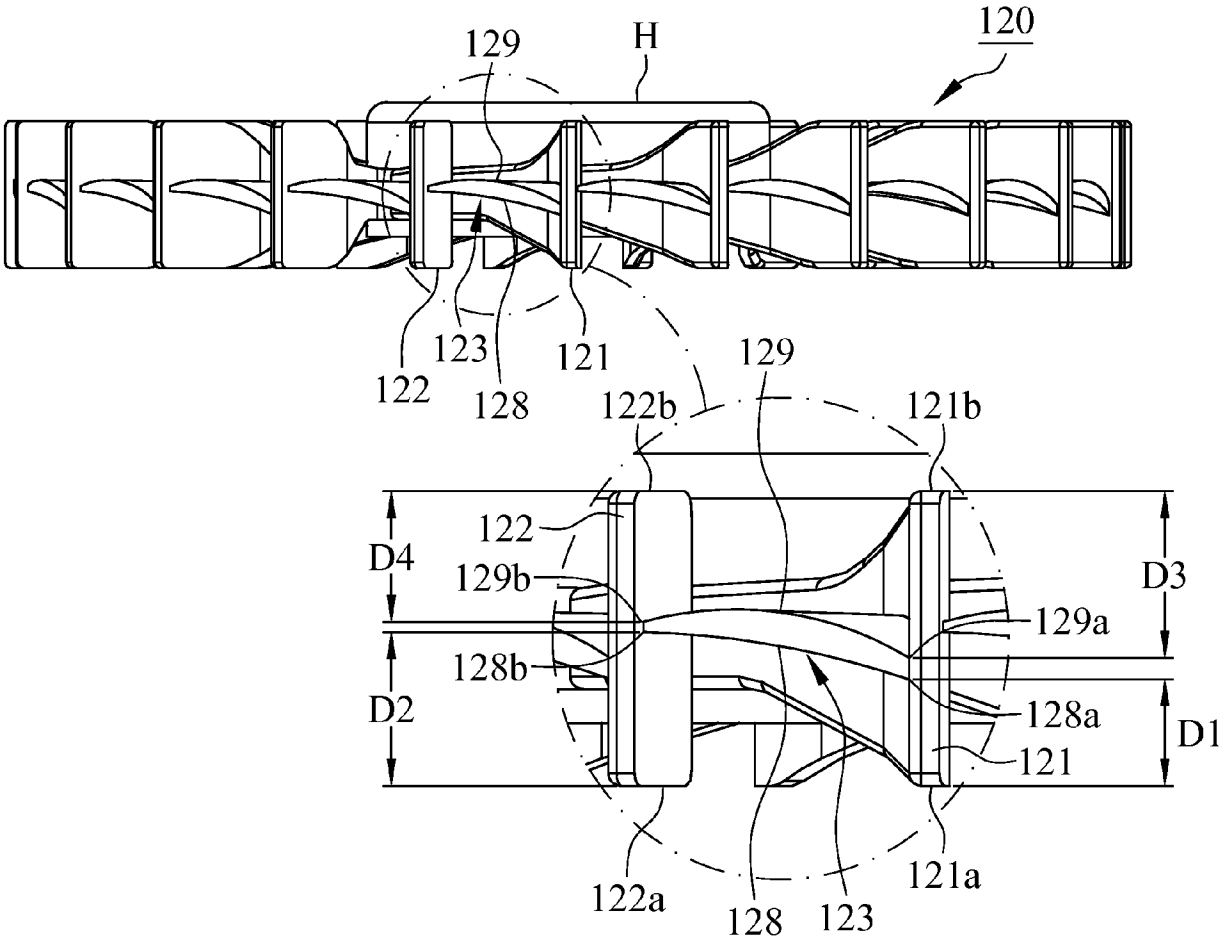
FIG. 10 is a lateral view illustrating an impeller of a heat-dissipation fan in accordance with a second embodiment of the present invention.
Figure 11:
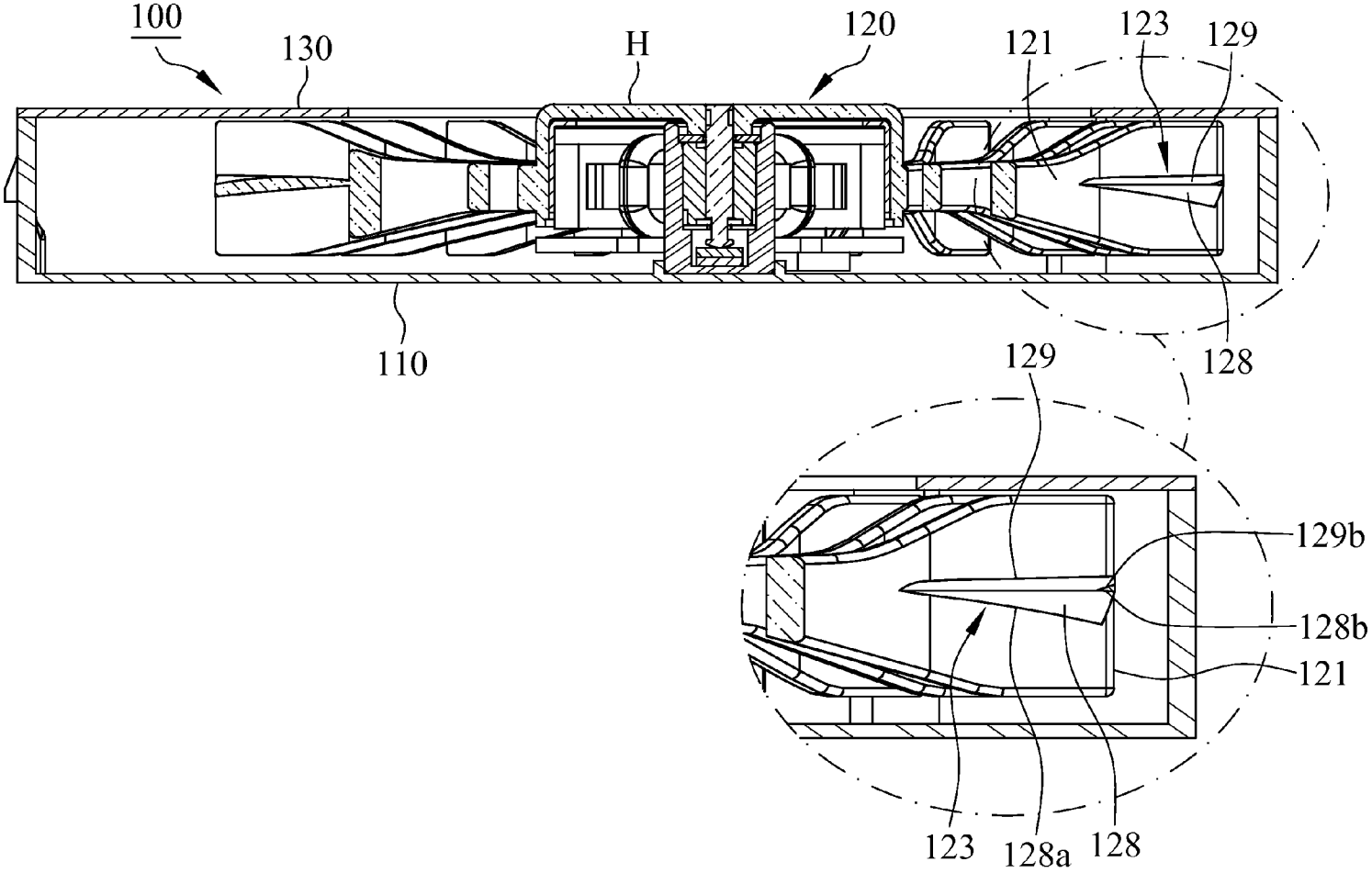
FIG. 11 is a lateral section view illustrating an impeller of a heat-dissipation fan in accordance with a second embodiment of the present invention.
Figure 12:
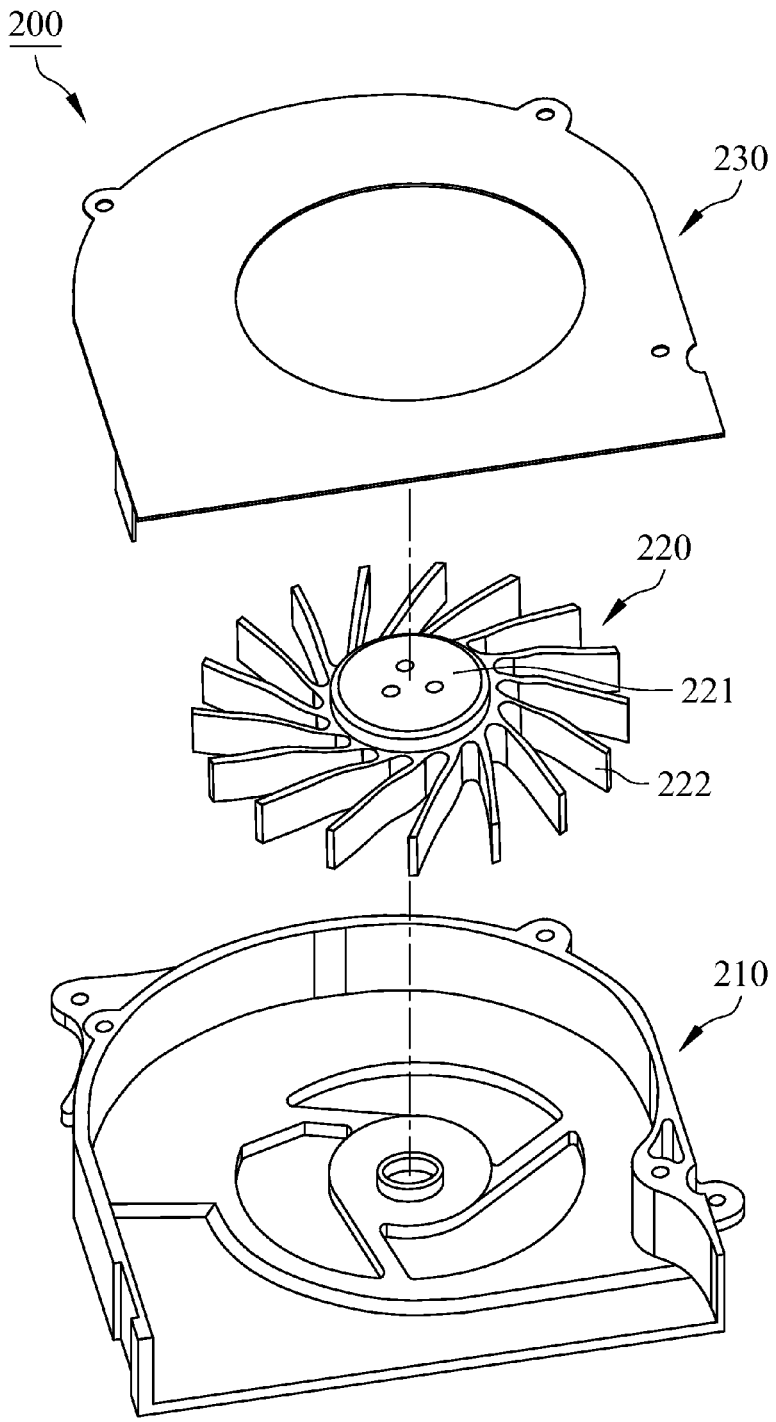
FIG. 12 PRIOR ART
FIG. 12 is a perspective exploded view illustrating a conventional heat-dissipation fan.

The heat-dissipation fan 100 in accordance with a second embodiment as illustrated in FIGS. 6, 7 and 8 includes a base 110, an impeller 120 disposed at the base 110 and a lid 130, wherein the impeller 120 is covered with the lid 130. The impeller 120 includes a hub H, a plurality of first blades 121 disposed around the hub H, a plurality of second blades 122 disposed around the hub H and a plurality of connection ribs 123. Each of the connection ribs 123 comprises a first edge 124, a second edge 125, a third edge 126, a bottom surface 128 and a top surface 129. The first edge 124 is connected with the first blade 121, the second edge 125 is connected with the second blade 122, and the third edge 126 is connected with the first edge 124 and the second edge 125. The third edge 126, the first blade 121 and the second blade 122 are spaced apart to form a first vent S1, and the lid 130 comprises a top opening 131 corresponded to the first vent S1. With reference to FIGS. 8 and 9, the first edge 124 comprises a first length L1, the second edge 125 comprises a second length L2, and the first length L1 is larger than the second length L2. In this invention, the third edge 126 includes a first side edge 126*a* and a second side edge 126*b*. A rotation center O of the impeller 120 is utilized as a base point so that a first arc length A1 can be defined between the first side edge 126*a* and the first edge 124, a second arc length A2 can be defined between the second side edge 126*b* and the first edge 124, and a third arc length A3 can be defined between the second edge 125 and the first edge 124. The third arc length A3 is larger than the second arc length A2, and the second arc length A2 is larger than the first arc length A1. With reference to FIGS. 10 and 11, the primary difference between the second embodiment and the first embodiment is that the bottom surface 128 and the top surface 129 of the connection rib 123 are curved surfaces. Besides, the bottom surface 128 comprises a first fringe 128*a* and a second fringe 128*b*, the first blade 121 comprises a first bottom edge 121*a* and a first top edge 121*b*, and the second blade 122 comprises a second bottom edge 122*a* and a second top edge 122*b*. The first bottom edge 121*a* and the first fringe 128*a* are spaced apart by a first spacing D1, the second bottom edge 122*a* and the second fringe 128*b* are spaced apart by a second spacing D2, and the second spacing D2 is not smaller than the first spacing D1. Furthermore, the top surface 129 comprises a third fringe 129*a* and a fourth fringe 129*b*, the first top edge 121*b* and the third fringe 129*a* are spaced apart by a third spacing D3, the second top edge 122*b* and the fourth fringe 129*b* are spaced apart by a fourth spacing D4, and the third spacing D3 is not smaller than the fourth spacing D4. The top surface 129 and the bottom surface 128 of each of the connection ribs 123 are asymmetric from each other to form an arcuate curved surface. When the impeller 120 of the heat-dissipation fan 100 starts rotation, the air penetrated between the first blade 121 and the second blade 122 can be divided into two parts via the connection rib 123. The two parts of the air flow along the top surface 129 and the bottom surface 128 of the connection rib 123. Owning to the reason that the top surface 129 can be a curved surface from top (third fringe 129*a*) to bottom (fourth fringe 129*b*), through the flow guidance of the curved surface, the air can be beaten by the first blade 121 more smoothly therefore discharging laterally, which may increase lateral air volume of heat dissipation. Besides, for the reason that an air disturbance is absent between the first blade 121 and the second blade 122, annoying noises caused from air disturbance can be avoidable.

In this invention, the connection rib 123 is formed into a divergent shape from the hub H to a fourth edge 127 of the connection rib 123, and each of the connection ribs 123 can be roughly sickle-shaped. When the impeller 120 of the heat-dissipation fan 100 starts rotation, the air penetrated between the first blade 121 and the second blade 122 can be divided into two parts via the connection rib 123. The two parts of the air flow along the top surface 129 and the bottom surface 128 of the connection rib 123, and the divided air is then beaten by the first blade 121 so as to discharge laterally, which may prevent an air disturbance between the first blade 121 and the second blade 122 from happening to increase lateral air volume of heat dissipation. Besides, owning to the reason that the air disturbance is absent between the first blade 121 and the second blade 122, annoying noises caused from air disturbance can be avoidable.

While this invention has been particularly illustrated and described in detail with respect to the preferred embodiments thereof, it will be clearly understood by those skilled in the art that it is not limited to the specific features and describes and various modifications and changes in form and details may be made without departing from the spirit and scope of this invention.

What is claimed is:

1. A heat-dissipation fan including:

a base; and an impeller disposed at the base including:

a hub;

a plurality of first blades disposed around the hub;

a plurality of second blades disposed around the hub, wherein each of the first blades and each of the second blades are arranged alternately; and a plurality of connection ribs, wherein each of the connection ribs comprises a first edge, a second edge and a third edge, the first edge is connected with the first blade, the second edge is connected with the second blade, the third edge is connected with the first edge and the second edge, the third edge and the second blade are spaced apart to form a first vent, the first edge comprises a first length, the second edge comprises a second length, and the first length is larger than the second length and wherein the third edge of the connection rib includes a first side edge and a second side edge, a first arc length defined between the first side edge and the first edge, a second arc length defined between the second side edge and the first edge, and a third arc length defined between the second edge and the first edge, wherein the third arc length is larger than the second arc length, and the second arc length is larger than the first arc length and wherein each of the connection ribs further comprises a fourth edge in connection with the first edge and the second edge, wherein the fourth edge is farther from the hub than the third edge, each of the second blades comprises a lateral, and the fourth edge and the lateral are spaced apart to form a second vent.

2. The heat-dissipation fan in accordance with claim 1 further includes a lid, wherein the lid covers the impeller and couples to the base, the lid comprises a top opening corresponded to the first vent.

3. The heat-dissipation fan in accordance with claim 2, wherein the base comprises at least one bottom opening corresponded to the first vent.

4. The heat-dissipation fan in accordance with claim 2, wherein the third edge is not parallel to the fourth edge.

5. The heat-dissipation fan in accordance with claim 2, wherein each of the first blades comprises a surface, an inclined angle between the first side edge of the third edge and the surface ranges from 15 to 30 degrees.

6. The heat-dissipation fan in accordance with claim 1, wherein the third edge is not parallel to the fourth edge.

7. The heat-dissipation fan in accordance with claim 1, wherein each of the first blades comprises a surface, an inclined angle between the first side edge of the third edge and the surface ranges from 15 to 30 degrees.

8. The heat-dissipation fan in accordance with claim 1, wherein the connection rib comprises a bottom surface proximal the base and wherein the bottom surface is a curved surface.

9. The heat-dissipation fan in accordance with claim 8, wherein the bottom surface of the connection rib comprises a first fringe and a second fringe, the first blade comprises a first bottom edge proximal the base, the second blade comprises a second bottom edge proximal the base, the first bottom edge and the first fringe are spaced apart by a first spacing, the second bottom edge and the second fringe are spaced apart by a second spacing, and the second spacing is not smaller than the first spacing.

10. The heat-dissipation fan in accordance with claim 1, wherein the connection rib comprises a top surface and wherein the top surface is a curved surface.

11. The heat-dissipation fan in accordance with claim 10, wherein the top surface of the connection rib comprises a third fringe and a fourth fringe, the first blade comprises a first top edge, the second blade comprises a second top edge, the first top edge and the third fringe are spaced apart by a third spacing, the second top edge and the fourth fringe are spaced apart by a fourth spacing, and the third spacing is not smaller than the fourth spacing.

12. The heat-dissipation fan in accordance with claim 1, wherein each of the connection ribs comprises a top surface and a bottom surface, the bottom surface and the top surface are asymmetric from each other to form an arcuate curved surface.

13. A heat-dissipation fan including:

a base; and an impeller disposed at the base including:

a hub;

a plurality of first blades disposed around the hub;

a plurality of second blades disposed around the hub, wherein each of the first blades and each of the second blades are arranged alternately; and a plurality of connection ribs, wherein each of the connection ribs comprises:

a top surface and a bottom surface, wherein the bottom surface and the top surface are asymmetric from each other to form an arcuate curved surface, a first edge, a second edge, and a third edge, the first edge is connected with the first blade, the second edge is connected with the second blade, the third edge is connected with the first edge and the second edge, the third edge and the second blade are spaced apart to form a first vent, the first edge comprises a first length, the second edge comprises a second length, and the first length is larger than the second length.

14. A heat-dissipation fan including:

a base;

an impeller disposed at the base including:

a hub;

a plurality of first blades disposed around the hub;

a plurality of second blades disposed around the hub, wherein each of the first blades and each of the second blades are arranged alternately;

a plurality of connection ribs, wherein each of the connection ribs comprises:

a first edge, a second edge, a third edge, wherein the first edge is connected with the first blade, the second edge is connected with the second blade, the third edge is connected with the first edge and the second edge, the third edge and the second blade are spaced apart to form a first vent, the first edge comprises a first length, the second edge comprises a second length, and the first length is larger than the second length and wherein the third edge of the connection rib includes a first side edge and a second side edge, a first arc length defined between the first side edge and the first edge, a second arc length defined between the second side edge and the first edge, a third arc length defined between the second edge and the first edge, the third arc length is larger than the second arc length, and the second arc length is larger than the first arc length, and a fourth edge in connection with the first edge and the second edge, wherein the fourth edge is farther from the hub than the third edge, each of the second blades comprises a lateral, the fourth edge and the lateral are spaced apart to form a second vent; and a lid, wherein the lid covers the impeller and couples to the base and comprises a top opening corresponding to the first vent.

* * * * *